US007090521B2

(12) United States Patent
Nishio et al.

(10) Patent No.: US 7,090,521 B2
(45) Date of Patent: Aug. 15, 2006

(54) FLOATING CONNECTOR

(75) Inventors: Atsushi Nishio, Ibaraki (JP); Yoshinori Ohta, Ibaraki (JP); Yasuhiko Shinohara, Ibaraki (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 11/066,061

(22) Filed: Feb. 25, 2005

(65) Prior Publication Data

US 2006/0105603 A1 May 18, 2006

(30) Foreign Application Priority Data

Nov. 18, 2004 (JP) ..... 2004-334912

(51) Int. Cl.
*H01R 13/64* (2006.01)

(52) U.S. Cl. ..... 439/248

(58) Field of Classification Search ..... 439/248, 439/247, 378, 374

See application file for complete search history.

(56) References Cited

U.S. PATENT DOCUMENTS 5,383,790 A * 1/1995 Kerek et al. ..... 439/248
5,769,652 A * 6/1998 Wider ..... 439/248
6,588,880 B1 * 7/2003 Gasvoda et al. ..... 347/50
6,592,388 B1 * 7/2003 Meiners et al. ..... 439/310
6,679,712 B1 * 1/2004 Chang ..... 439/248
6,786,691 B1 * 9/2004 Alden, III ..... 411/371.2

FOREIGN PATENT DOCUMENTS

JP 08-138329 12/1997
JP 08-224589 2/1998
JP 09-178979 1/1999

* cited by examiner

*Primary Examiner*—Tulsidas C. Patel
*Assistant Examiner*—Phuongchi Nguyen
(74) *Attorney, Agent, or Firm*—Patents&TMS, P.C.

(57) ABSTRACT

A floating connector includes a connector 2 having a base side, a flange-like connecting portion 3 provided on the base side of the connector 2, a base 4 for supporting the connecting portion 3, and a pair of coil springs 5 provided between the connecting portion 3 and the base 4 for supporting the connector in a floating state. The coil springs 5 are supported by coil spring receiving portions 31 provided in the connecting portion 3 and coil spring supporting bosses 41 provided on the base 4 so that the coil springs 5 can extend and contract in an inserting direction of a mating connector to be connected as well as to bend laterally in swing directions of the connector 2.

3 Claims, 8 Drawing Sheets

FLOATING CONNECTOR

This application claims the benefit of Japanese Patent Application No.: 2004-334912, filed on Nov. 18, 2004.

BACKGROUND OF THE INVENTION

1. Field of the Invention

The present invention relates to a floating connector.

2. Description of the Prior Art

A connector called a floating connector is known. The floating connector is used in a connector apparatus which comprises a plug (plug connector) and a receptacle (receptacle connector), in which either the plug or the receptacle is configured into the floating connector. In such a floating connector, either a plug connector or a receptacle connector is movably provided on a base in a floating state so as to be able to absorb misalignment between the floating connector and a mating connector to be connected when connecting these two connectors. Since the connector apparatus provided with such a floating connector can absorb misalignment between two connectors to be connected, it is suitably used when connecting two electronic devices housed in casings such as a laptop computer and a removable battery or when connecting a digital camera to a printer or a charging dock, for example.

As conventional floating connectors, those disclosed in the following publications are known:

Japanese Laid-Open Patent Publication No. 9-320708;

Japanese Laid-Open Patent Publication No. 10-55856; and

Japanese Laid-Open Patent Publication No. 11-16633.

As disclosed in the above publications, in these floating connectors, rubber members or arms made of a resin material are used for producing a floating state.

However, such floating connecters using the rubber members or arms have a problem in that a good floating function cannot be maintained and a restoring function to a normal position is becoming decreased since the materials of the rubber member and the arms are likely to be deteriorated due to a long-term use. Further, there is another problem in that it is difficult to precisely control a stroke of the floating action of the connector.

In view of the problems described above, it is an object of the present invention to provide a floating connector which can maintain a good floating function and a restoring function to a normal position for a long period of time and also can precisely control a stroke of the floating action of the connector.

SUMMARY OF THE INVENTION

In order to achieve the above object, a floating connector according to the present invention comprises a connector having a base side, a flange-like connecting portion provided on the base side of the connector, a base which supports the connecting portion, and at least two coil springs provided between the connecting portion and the base for supporting the connector in a floating state.

According to the above structure, it is possible for the connector to maintain a good floating function and a restoring function to a normal position for a long period of time since the coil springs are used in the floating support portion which includes the connecting portion and the base.

Further, in the floating connector according to the present invention, it is preferred that each of the at least two coil springs is provided so as to extend and contract in an inserting direction of a mating connector to be connected as well as to bend laterally in swing directions of the connector when connecting the mating connector.

According to the floating connector having such a structure, it is possible to precisely control each of the strokes in the different directions independently by selecting the shape of the coil springs since the expanding and contracting action of each coil spring is used as a stroke of the connector in the inserting direction of the mating connector, and the lateral bending action of each coil spring is used as a stroke of the connector in the swing directions.

Further, in the floating connector according to the present invention, it is preferred that the expanding and contracting action of the coil springs is restricted when the connecting portion abuts on a part of the base and the lateral bending action of the coil springs is restricted when a part of the connector abuts on a part of the base.

According to the floating connector having such a structure, since a restricting means is provided for each of the motion of the connector in the inserting direction of the mating connector and the motion of the connector in the swing directions independently, it is possible to precisely control the stroke in each direction independently.

Further, in the floating connector according to the present invention, it is preferred that the base has coil spring supporting bosses, and the coil springs are respectively held on the base by means of the corresponding coil spring supporting bosses.

According to the floating connector having such a structure, it is possible to easily mount the coil springs onto the base when assembling the floating connector.

Further, in the floating connector according to the present invention, it is preferred that each of the coil springs has a large diameter portion in which a coil is wound so as to have a large diameter and such a coil spring is connected to the connecting portion through the large diameter portion.

According to the present invention, the large diameter portion of each coil spring prevents the coil spring from interfering with the coil spring supporting boss when the coil spring bends laterally.

These and other objects, structures and effects of the present invention will be apparent when the following description of the preferred embodiments are considered taken in conjunction with the appended drawings.

DETAILED DESCRIPTION OF THE INVENTION

Hereinafter, a floating connector according to the present invention will be described in detail with reference to preferred embodiments shown in the appended drawings.

Figure 1:
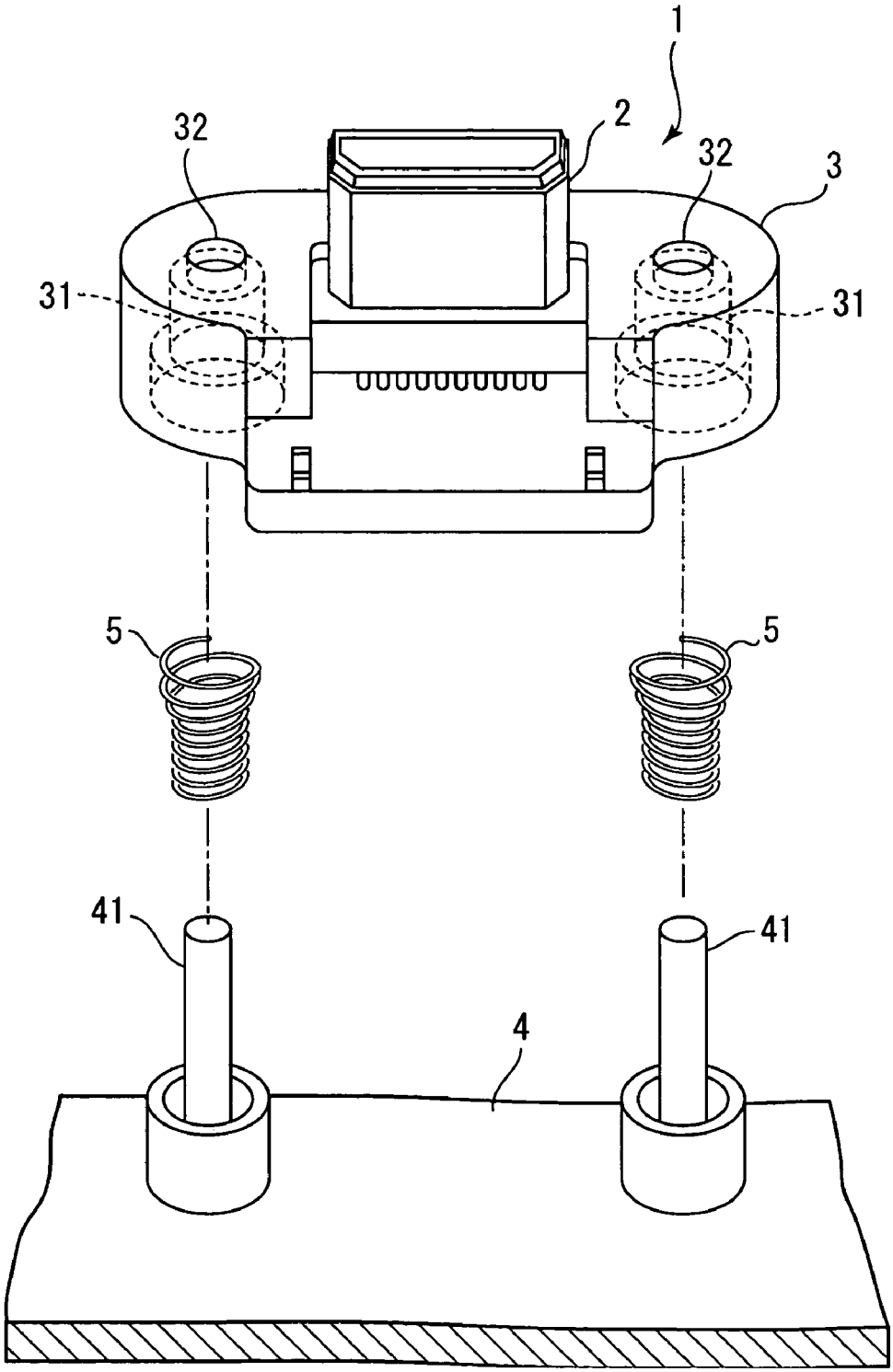
FIG. 1 is an exploded perspective view which shows a floating connector according to a first embodiment of the present invention.
Figure 2:
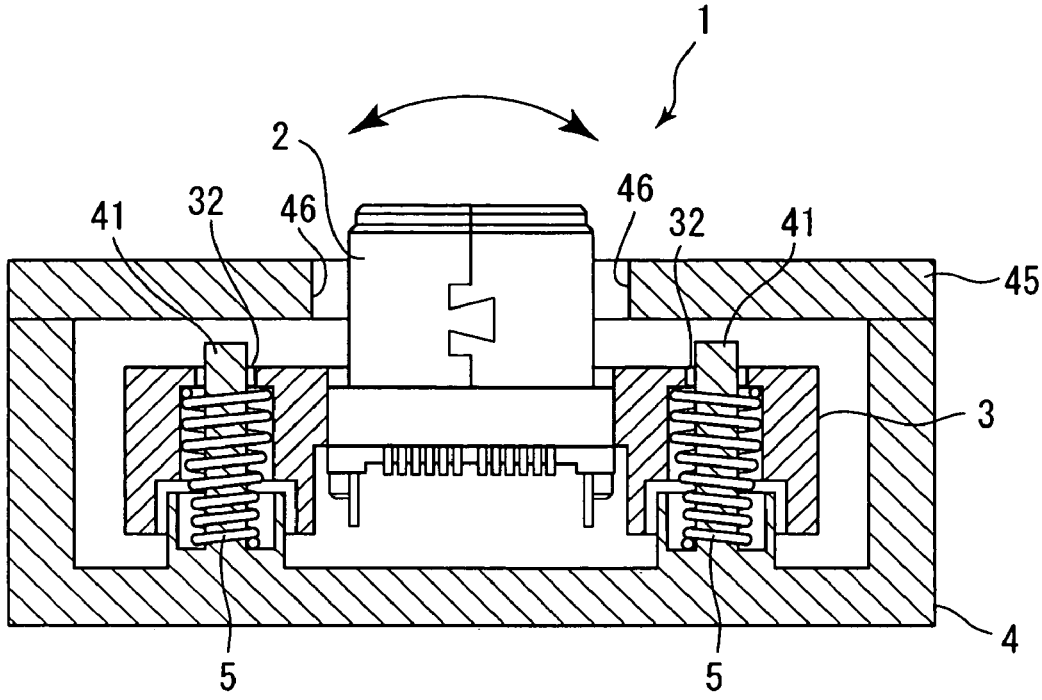
FIG. 2 is a cross-sectional view which shows the floating connector according to the first embodiment of the present invention.
Figure 3:
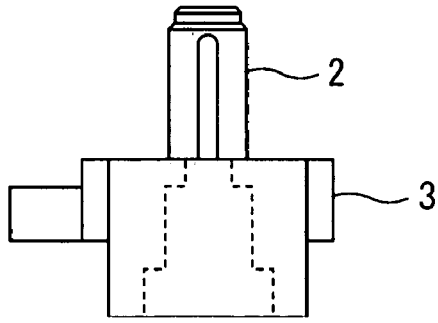
FIG. 3 is a side view which shows a connector and a connecting portion of the floating connector shown in FIG. 1 and FIG. 2.
Figure 4:
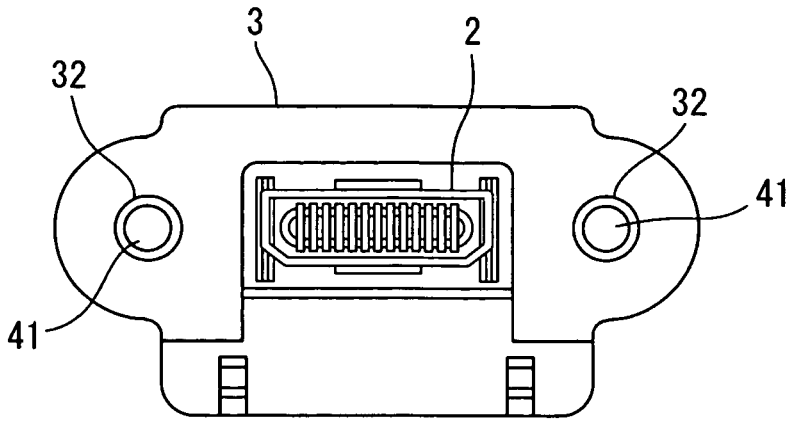
FIG. 4 is a plan view which shows the connector and the connecting portion of the floating connector shown in FIG. 1 and FIG. 2.
Figure 5:
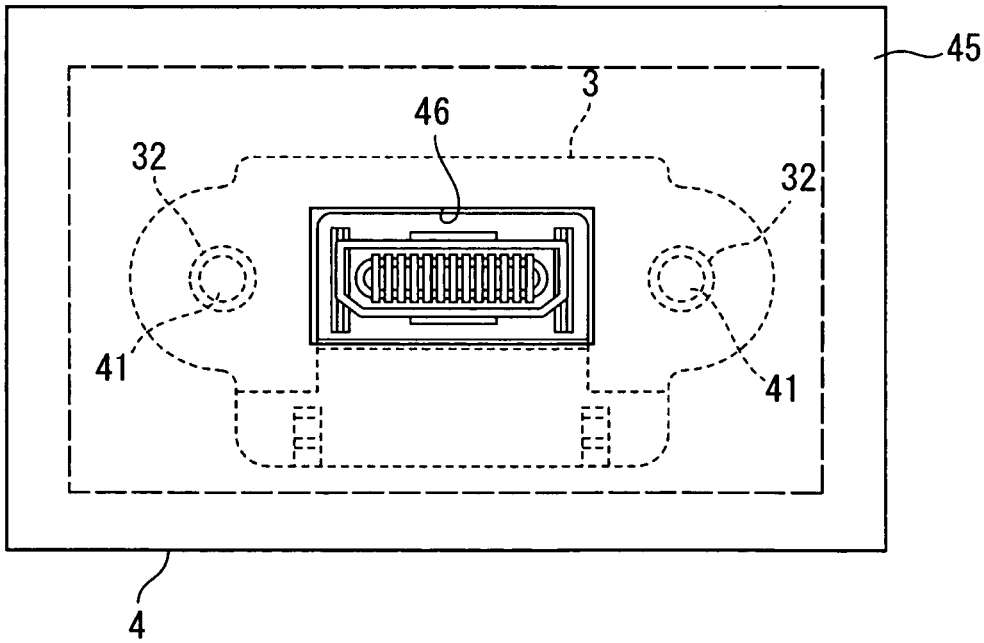
FIG. 5 is a plan view which shows the floating connector shown in FIG. 1 and FIG. 2.

FIG. 1 is an exploded perspective view which shows a floating connector according to a first embodiment of the present invention, FIG. 2 is a cross sectional view which shows the floating connector shown in FIG. 1, FIG. 3 is a side view which shows a connector 2 and a connecting portion 3 of the floating connector 1 shown in FIG. 1 and FIG. 2, FIG. 4 is a plan view which shows the connector 2 and the connecting portion 3 of the floating connector 1 shown in FIG. 1 and FIG. 2, and FIG. 5 is a plan view which shows the floating connector 1 shown in FIG. 1 and FIG. 2.

The floating connector 1 is provided with a connector 2 having a base side, a flange-like connecting portion 3 provided on the base side of the connector 2, a base 4 for supporting the connecting portion 3, and a pair of coil springs 5 provided between the connecting portion 3 and the base 4 for supporting the connector in a floating state. The base portion of the connector 2 is fixed with the flange-like connecting portion 3 and the connecting portion 3 is supported with respect to the base 4 by the coil springs 5. Therefore, the connector 2 is supported in a floating state with respect to the base 4 in a floating state. Further, in this embodiment, the connector 2 is a receptacle connector which constitutes a connector apparatus with a mating plug connector to be connected thereto (not shown in the drawings).

As shown in FIG. 1 and FIG. 2, the connecting portion 3 is provided with a pair of coil spring receiving concave portions 31. These coil spring receiving concave portions 31 are formed in the lower surface of the connecting portion 3 at positions corresponding to the both sides of the connector 2. The upper inner surface of each of the coil spring receiving portions 31 holds the upper portion of each of the coil springs 5. Further, a pair of through holes 32 are formed in the upper surface of the connecting portion 3 at positions corresponding to the coil spring receiving portions 31. (See FIG. 1 and FIG. 2).

A pair of coil spring supporting bosses 41 each having a rod-like shape are provided on the base 4 so as to stand out from the base 4 at positions corresponding to the respective coil spring receiving portions 31 of the connecting portion 3. Each of the coil spring supporting bosses 41 has a diameter smaller than the diameter of each through hole 32 so that a predetermined space is provided between the inner surface of each through hole 32 and the outer surface of each coil spring supporting boss 41 (See FIG. 2). The outer surface of the lower portion of each of the coil spring supporting bosses 41 holds the inside of the lower portion of each of the coil springs 5. The coil spring supporting bosses 41 make it possible to easily mount the coil springs 5 onto the base 4 when assembling the floating connector 1. Further, as shown in FIG. 2, the base 4 has a cover 45 which covers a top of the base 4, and an opening 46 from which the connector 2 protrudes is formed in the cover 45. As shown in FIG. 5, a predetermined space is provided between the inner surface of the opening 46 and the outer surface of the connector 2 for allowing the connector 2 to be displaced through the space.

Further, the connecting portion 3 and the base 4 are disposed with a predetermined distance therebetween in the inserting direction of a mating connector to be connected. Therefore, the connecting portion 3 can move through the predetermined distance in the inserting direction of the mating connector with respect to the base 4 according to the expansion and contraction of the coil springs 5. Namely, in FIG. 2, the connector 2 can move through the predetermined distance between the connecting portion 3 and the base 4 in the inserting direction of the mating connector. Then, the stroke of the connector 2 in the inserting direction of the mating connector is restricted when the connecting portion 3 abuts on the base 4.

As shown in FIG. 1 and FIG. 2, each of the coil springs 5 is wound in a spiral form from bottom to top with its diameter expanding gradually. As a result, a predetermined space exists between the inside of each of the coil springs 5 and the outer surface of each of the coil spring supporting bosses 41 at the upper portion of each of the coil springs 5. According to this structure, since the bottom portion of each of the coil springs 5 is held by each of the coil spring supporting bosses 41, the upper portion of each of the coil springs 5 can move through the predetermined space defined between the inner surface of the through hole 32 and the outer surface of the coil spring supporting boss 41. As a result, the connector 2 can also move or displace within the space defined between the inner surface of the opening 46 and the outer surface of the connector 2 in the swing directions with the bottom portion of each of the coil springs 5 being used as a stationary part for the swinging motions. Namely, it is possible to move or displace the connector 2 in the swing directions indicated by an arrow shown in FIG. 2 when the coil springs 5 bend laterally. In this case, the top portion of each of the coil springs 5 where the diameter thereof gradually expands prevents the coil spring 5 from interfering with the coil spring supporting boss 41. Further, this stroke of the connector 2 in the swing directions of the connector is restricted when the outer surface of the connector 2 abuts on the inner surface of the opening 46 of the cover 45.

As shown in FIG. 1, an assembly of the floating connector 1 according to this embodiment is carried out through the following steps. First, each of the coil springs 5 is inserted into each of the coil spring supporting bosses 41 on the base 4. Then, the connecting portion 3 is placed on the base 4 so that each of the coil springs 5 is fitted in each of the coil spring receiving portions 31. Finally, the cover 45 is placed on the top of the base 4.

Figure 6:
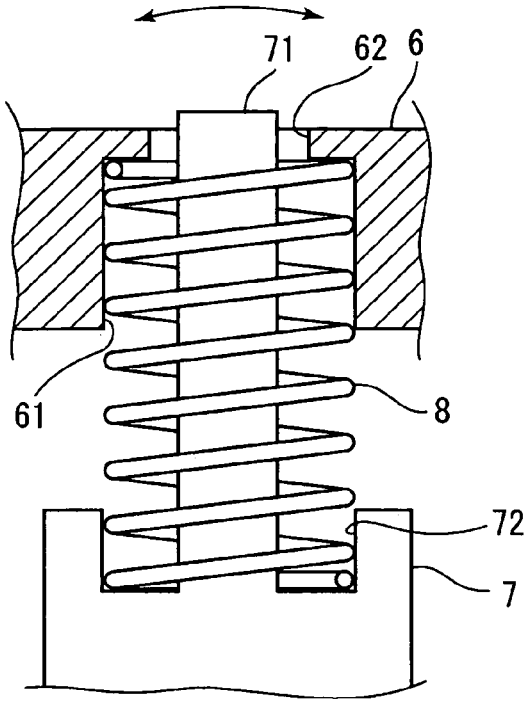
FIG. 6 is a fragmentary cross-sectional view which shows a floating support portion of a floating connector according to a second embodiment of the present invention.

Next, a second embodiment of the present invention will be described with reference to FIG. 6. A floating support portion according to the second embodiment shown in FIG. 6 is characterized in that a bottom portion of a coil spring 8 is held by a coil spring receiving concave portion 72 of a base 7. Further, in FIG. 6, the reference numeral 6 denotes a connecting portion and the reference numeral 61 denotes a coil spring receiving portion of the connecting portion 6. Further, in this embodiment, a stroke of the connector 2 in swing directions of the connector 2 is restricted when an inner surface of a through hole 62 abuts on an outer surface of a coil spring supporting boss 71. According to this embodiment, it is possible to constitute the floating supporting portion without using a coil spring having a specific shape such as the coil spring 5 used in the first embodiment.

Figure 7:
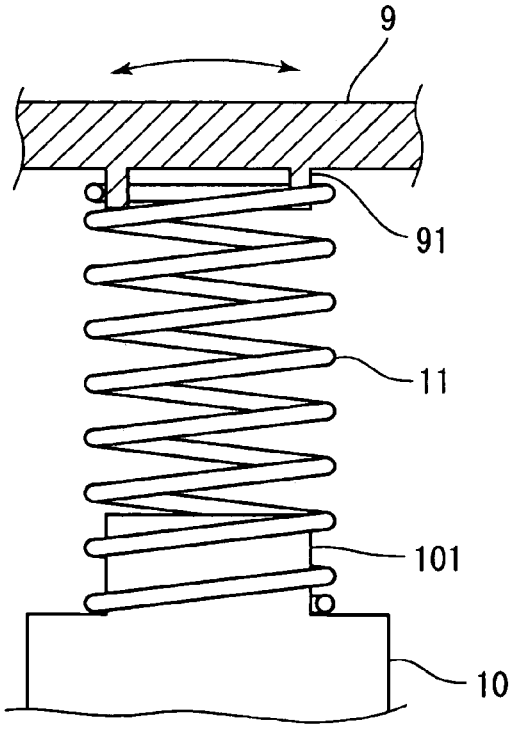
FIG. 7 is a fragmentary cross-sectional view which shows a floating support portion of a floating connector according to a third embodiment of the present invention.

Next, a third embodiment of the present invention will be described with reference to FIG. 7. A floating support portion according to the third embodiment shown in FIG. 7 is characterized in that coil spring supporting bosses 91, 101 do not extend through the entire length of a coil spring 11. The inside of the upper portion of the coil spring 11 is supported by the coil spring supporting boss 91 which is provided on a lower surface of a connecting portion 9 so as to protrude therefrom, and the inside of the lower portion of the coil spring 11 is supported by the coil spring supporting boss 101 which is provided on an upper surface of a base 10 so as to protrude therefrom. Further, in this embodiment, a stroke of the connector 2 in the swing directions of the connector is restricted when the inner surface of an opening formed in a cover for covering a top of the base (not shown in the drawings) abuts on the outer surface of the connector in the same manner as the first embodiment.

Figure 8:
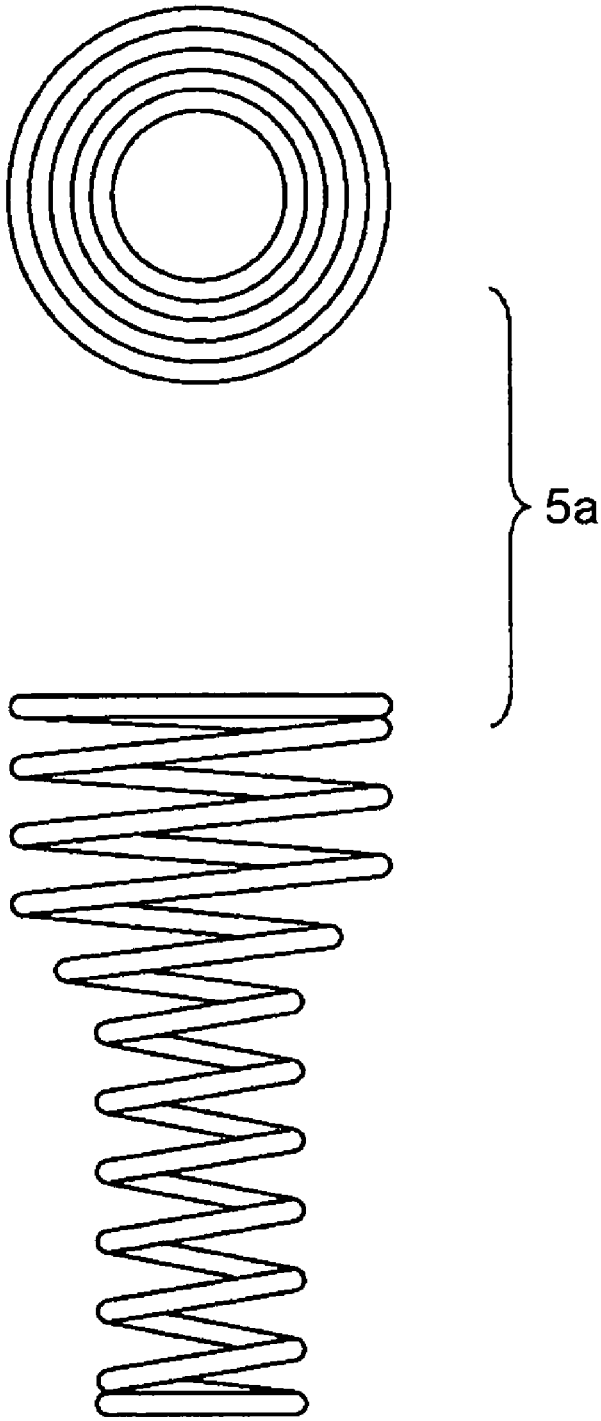
FIG. 8 is a plan view and a side view which show a modified example of a coil spring used in the floating connector according to the present invention.
Figure 9:
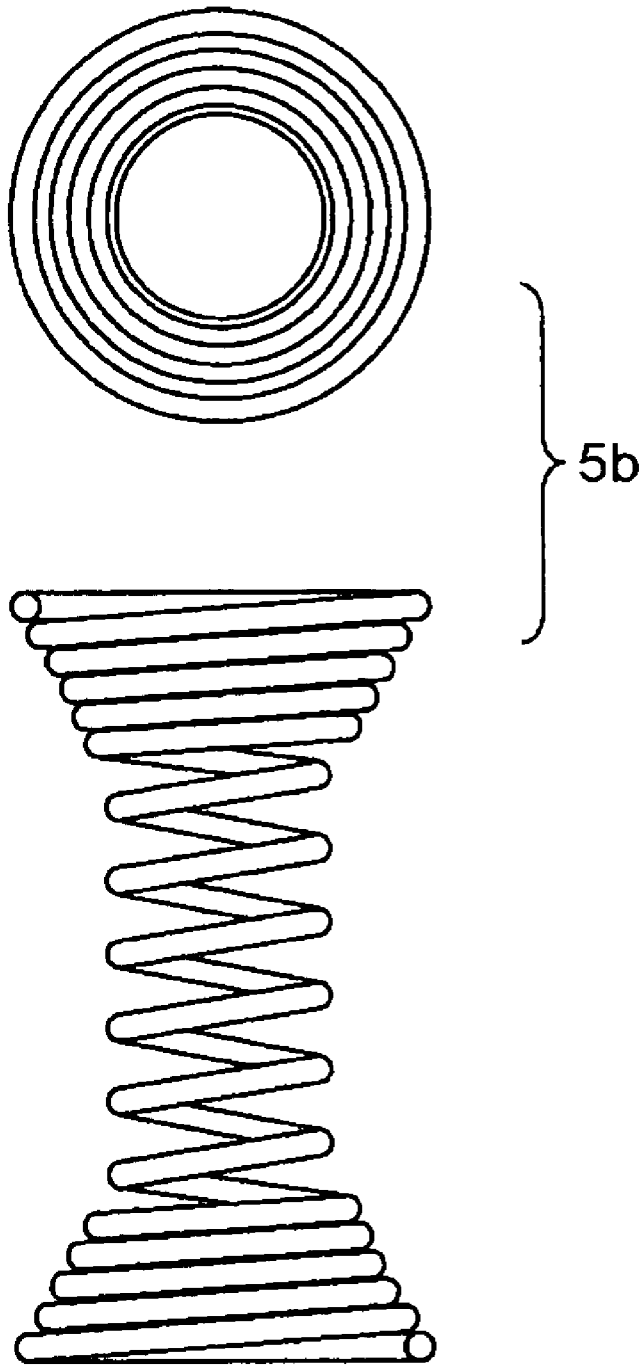
FIG. 9 is a plan view and a side view which show another modified example of the coil spring used in the floating connector according to the present invention.
Figure 10:
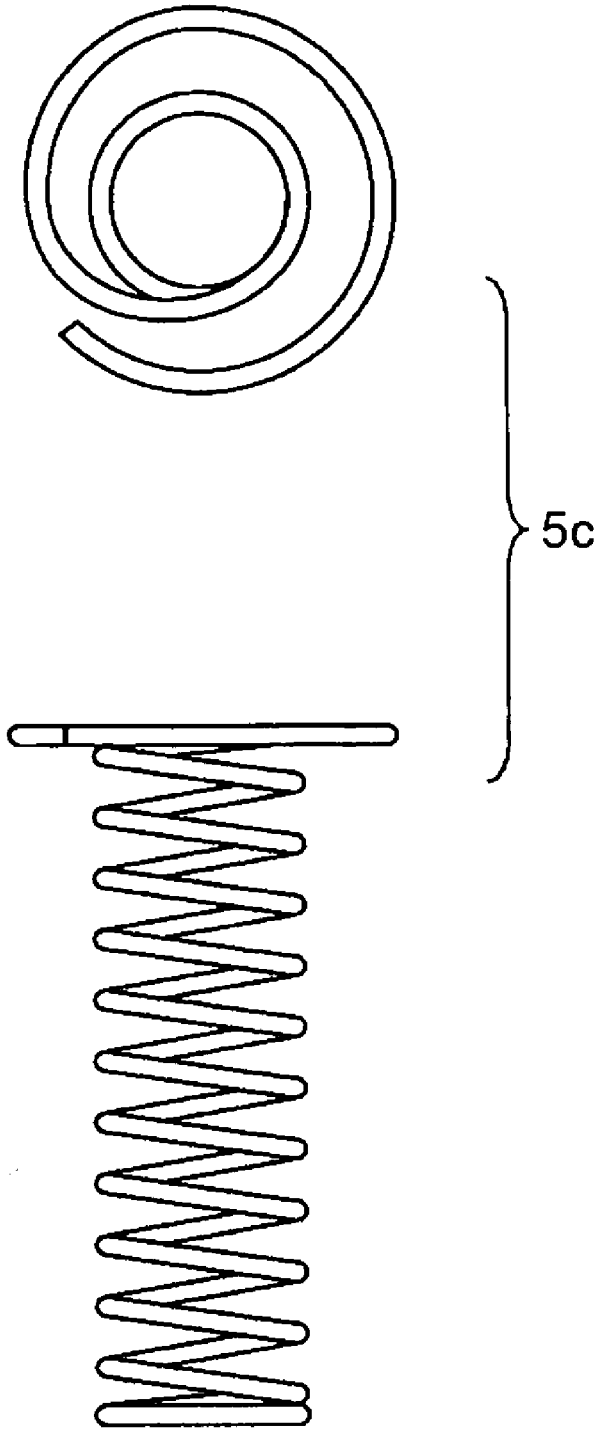
FIG. 10 is a plan view and a side view which show yet another modified example of the coil spring used in the floating connector according to the present invention.
Figure 11:
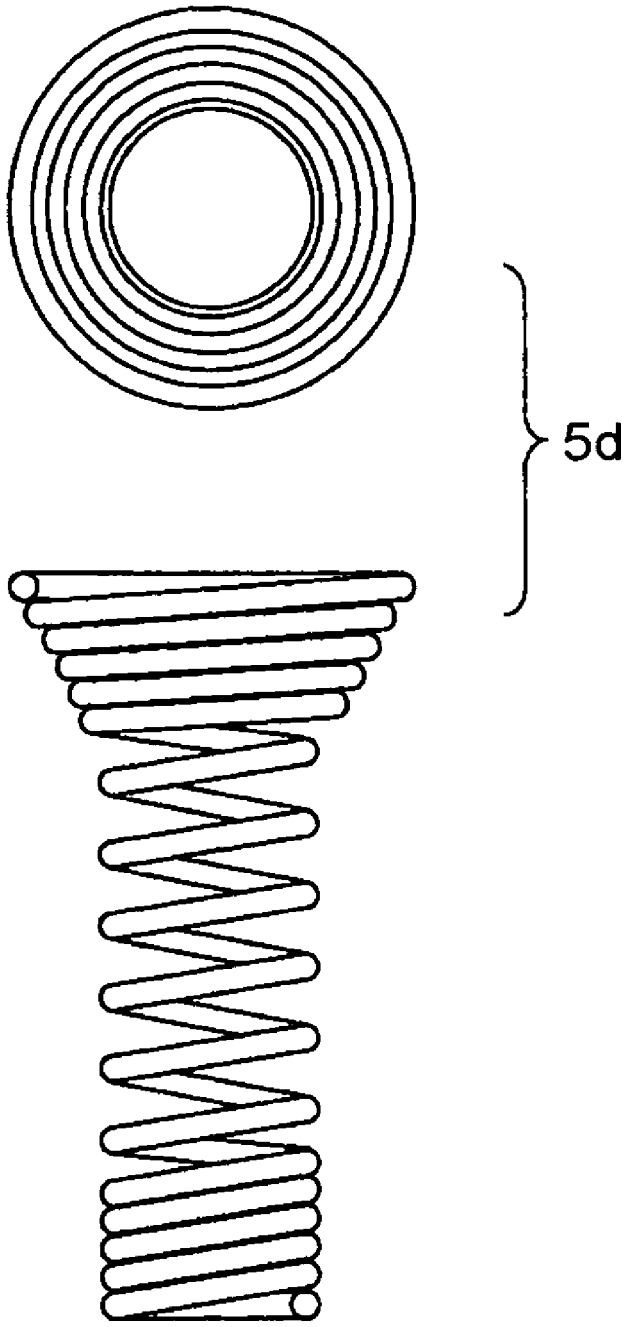
FIG. 11 is a plan view and a side view which show another modified example of the coil spring used in the floating connector according to the present invention.

Next, modifications of the coil springs according to the present invention will be described with reference to FIG. 8 to FIG. 11. A coil spring 5*a* shown in FIG. 8 is compatible with the coil spring 5 of the first embodiment. According to the coil spring 5*a*, it is possible to set a stationary part for the stroke of the coil spring in the swing directions of the connector at a considerably upper position. Further, it is also possible to ensure an enough amount of stroke of the coil spring in the inserting direction of the mating connector. A coil spring 5*b* shown in FIG. 9 is compatible with the coil spring 8 of the second embodiment. According to the coil spring 5*b*, it is possible to distribute stress caused by the stroke of the coil spring in the swing directions of the connector into the upper portion and the lower portion of the coil spring. A coil spring 5*c* shown in FIG. 10 is compatible with the coil spring 11 of the third embodiment. The coil spring 5*c* is suitable for reducing the amount of stroke in the swing directions of the connector while ensuring an enough amount of stroke in the inserting direction of the mating connector. A coil spring 5*d* shown in FIG. 11 is compatible with the coil spring 5 of the first embodiment. The coil spring 5*d* is suitable for reducing the amount of stroke in the inserting direction of the mating connector.

Hereinafter, the effects of the present invention will be described.

According to the present invention, it is possible for the connector to maintain a good floating function and a restoring function to a normal position for a long period of time since the coil springs are used in the floating support portion.

Further, the expanding and contracting action of the coil spring is used as a stroke of the connector in the inserting direction of the mating connector. Furthermore, the lateral bending action of the coil spring is used as a stroke of the connector in the swing directions. As a result, it is possible to precisely control each of the strokes in the different directions separately by selecting the shape of the coil springs.

Further, since a restricting means is provided for each of the motion of the connector in the inserting direction of the mating connector and the motion of the connector in the swing directions independently, it is possible to precisely control the stroke in each direction independently.

In the above embodiment, the description has been made with respect to the case where a receptacle connector in a connector apparatus is configured into a floating connector. However, the present invention is not limited thereto. A plug connector may be configured into a floating connector, or both of a plug connector and a receptacle connector may be configured into a floating connector. Further, the connector 2 and the connecting portion 3 may be integrally formed.

Further, although the description has been made in the above embodiments based on the examples in which the two coil springs are provided, it is also possible to use more of the coil springs.

Furthermore, in the above embodiments, the description has been made with respect to the case where two electronic devices are connected through one connector apparatus which comprises the plug connector and the receptacle connector. However, in the case where two electronic devices are connected thorough a plurality of connector apparatuses, either the plug connector or the receptacle connector in each connector apparatus may be configured into the floating connector of the present invention.

We claim:

1. A floating connector, comprising:

a connector having a base side;

a flange-like connecting portion provided on the base side of the connector; and a base which supports the connecting portion; and at least two coil springs provided between the connecting portion and the base for supporting the connector in a floating state wherein each of the at least two coil springs is provided so as to extend and contract in an inserting direction of a mating connector to be connected as well as to bend laterally in swing directions of the connector when connecting the mate connector wherein the expanding and contracting action of the coil springs is restricted when the connecting portion abuts on a part of the base and the lateral bending action of the coil springs is restricted when a part of the connector abuts on a part of the base.

2. The floating connector as claimed in claim 1, wherein the base has coil spring supporting bosses, and the coil springs are respectively held on the base by means of the corresponding coil spring supporting bosses.

3. The floating connector as claimed in claim 1, wherein each of the coil springs has a large diameter portion in which a coil is wound so as to have a large diameter and each of the coil springs is connected to the connecting portion through the large diameter portion.

* * * * *